US005541472A

United States Patent [19]

Greiler et al.

[11] Patent Number: 5,541,472

[45] Date of Patent: Jul. 30, 1996

[54] HIGH-POWER, SINGLE-ENDED, HIGH-PRESSURE DISCHARGE LAMP WITH HOT-STARTING CAPABILITY

[75] Inventors: Wolfgang Greiler, Unterhaching; Bernd Lewandowski, Feldafing, both of Germany

[73] Assignee: Patent-Treuhand-Gesellschaft Fuer Elektrische Gluehlampen MBH, Munich, Germany

[21] Appl. No.: 518,958

[22] Filed: Aug. 24, 1995

Related U.S. Application Data

[63] Continuation of Ser. No. 44,307, Apr. 7, 1993, abandoned.

[30] Foreign Application Priority Data

Apr. 23, 1992 [DE] Germany ..... 92 05 537 U

[51] Int. Cl.[6] ..... H01J 5/54

[52] U.S. Cl. ..... 313/318.01

[58] Field of Search ..... 313/318.01

[56] References Cited

U.S. PATENT DOCUMENTS

| | | | |
|---|---|---|---|
| 3,610,983 | 10/1971 | Grabner et al. | 313/25 |
| 4,533,851 | 8/1985 | Block et al. | 313/51 |
| 4,758,760 | 7/1988 | Cox et al. | 313/43 |
| 4,866,341 | 9/1989 | Ichiga et al. | 313/623 |
| 4,985,656 | 1/1991 | Westlund, Jr. et al. | 313/318.05 |

FOREIGN PATENT DOCUMENTS

| | | | |
|---|---|---|---|
| 2100404 | 12/1982 | United Kingdom | H01J 61/00 |

*Primary Examiner*—Brian Zimmerman
*Assistant Examiner*—Lawrence D. Richardson
*Attorney, Agent, or Firm*—Frishauf, Holtz, Goodman, Langer & Chick, P.C.

[57] ABSTRACT

To be able to accept high-voltage pulses, in the order of 70 kV, required for re-starting a hot high-power high-pressure discharge lamp, having a power rating, for example, of 6 kW and up, including 12 kW, a ceramic base is provided with auxiliary mica strips or plates (13) positioned between part of the terminal posts or pins, and especially in the region of retentions flanges or rims formed thereon, and extending up to about the end portion (4*a*) of a pinch or press seal, into which connection leads extend, connected to the pins or posts. The additional mica strips or plates (13), for example located on both sides of a central separating strip (10), retained in suitable grooves or slots (14) formed in the base effectively prevent arc-over, creep currents and corona discharge between the terminal pins or posts (8*a*, 8*b*), the circumferentially projecting flanges or rims (16*a*, 16*b*) and the connected current supply leads (7*a*, 7*b*). Typically, the pins or posts are closer together than the current leads (7*a*, 7*b*) at their point of entry into the pinch or press-sealed end (4*a*) of the lamp bulb (4).

14 Claims, 4 Drawing Sheets

HIGH-POWER, SINGLE-ENDED, HIGH-PRESSURE DISCHARGE LAMP WITH HOT-STARTING CAPABILITY

This application is a Continuation of application Ser. No. 08/044,307, filed Apr. 7, 1993, now abandoned.

FIELD OF THE INVENTION

The present invention relates to a single-ended, high-pressure discharge lamp, and more particularly to such a lamp which is capable of being hot-started, and, additionally, is suitable for use at high power ratings, for example 6 kW, and up, for instance to about 12 kW. Such high-power lamps require, for hot-starting, a high-voltage starting pulse, in which the voltage may be up to about 70 kV.

BACKGROUND

It is well known that high-pressure discharge lamps, when hot, require a substantially higher ignition or firing voltage than when they are cold. If a high-pressure discharge lamp is deenergized, and should be re-started or ignited while still hot, the ignition voltage required for hot-starting is substantially higher than when the lamp has been permitted to be cooled. Many applications require high-pressure discharge lamps which are capable of being hot-started or re-started, as required, that is, can be turned ON, then OFF, and again turned ON, without awaiting an intermediate cooling phase.

Bases for such lamps are subject to extreme requirements with respect to resistance against arc-over and acceptability of high voltages. The bases must fit standard sockets.

High-pressure discharge lamps to which the present invention relates are generally described in the referenced U.S. Pat. No. 4,542,316, Hall et al, as well as in the British Patent 2 100 404, Ainsworth et al. For example, the British patent describes a lamp which has improved resistance to high voltages and can be re-started when hot. This lamp, however, is of limited power, and lamps of that type have a power rating below that to which the present invention relates. The British patent describes use of a ceramic separating strip or plate which extends between the contact terminals or contact pins extending from the lamp base, as well as between connecting leads to the contact pins or terminals. This strip may be part of the socket engaging in the slot of the lamp base between the contact pins or posts, or may be formed unitary with the ceramic base and fitting into a matching slit, slot, or depression in the lamp socket.

U.S. Pat. No. 4,542,316, Hall et al, is directed to a single-ended high-pressure discharge lamp which, also, can be re-started while hot. The lamp base has an improved high-voltage insulation formed by an axially extending strip of mica between the connecting leads of the lamp, located in a slot cut into or formed in the pinch seal of the lamp bulb. The mica strip is intended to suppress corona and creep currents between the current supply leads.

The lamps described have a base in which the high-voltage insulation is sufficient when the lamp itself has low or intermediate electric power rating. As the power rating for lamps increases, experiments have shown that the high-voltage resistance of the known bases is still not high enough in order to permit hot re-ignition of high-power single-ended high-pressure discharge lamps. High-pressure discharge lamps, thus, having power ratings of, for example, about 6,000 to 12,000 watts, require pulse voltages for re-ignition in the order of about 70,000 volts.

THE INVENTION

It is an object to provide a single-ended high-pressure discharge lamp of high power rating which is capable of being hot-re-ignited or re-started, and which is so constructed that its base is capable of withstanding the extremely high voltages required for re-ignition. Particularly, it is an object of the invention to provide a lamp having power ratings in the order of about 6 kW and higher, and which is capable of being hot-re-started.

Briefly, the base includes a separating strip, preferably of mica, as known; in addition, two further or additional separating strips are located in the base, preferably at respective opposite sides of the known central separating strip, and extending axially between at least part of the current supply leads and/or between the terminal pins or posts of the lamp.

In accordance with a feature of the invention, the additional separating strips, preferably also of mica, are inclined towards each other to permit formation of the base with a centering slot into which a separator, for example of ceramic, can engage. The additional insulating strips, of the highly electrically insulating material, thus provides additional insulation in the region where the terminal posts or pins have metallic elements which are closer together than at the locations of connecting leads to, for example, molybdenum foils melt-sealed into the bulb of the discharge lamp.

The additional separating strips of the highly electrically insulating material, for example mica, reliably suppress corona discharges between the current supply leads and/or the contact pins or posts, and internal flanges, required for mechanical retention thereof. Preferably, the further or additional separating strips extend in axial direction from the end of the base wall up to about, and preferably close to the end of the pinch seal which terminates the lamp bulb, and which is secured within the base. The additional separating strips also shield the electrically conductive and current and voltage-loaded elements within the base better against each other than heretofore, so that corona discharges between current supply leads at the high starting voltages are effectively avoided.

The base is formed, preferably, with an externally open slot between the connecting pins or posts, dimensioned for engagement by an insulating strip formed in the socket for the lamp. This arrangement effectively prevents creep currents between the contact posts along the boundary surfaces between the base and the socket into which the lamp is inserted.

DRAWINGS

DETAILED DESCRIPTION

Figure 1:
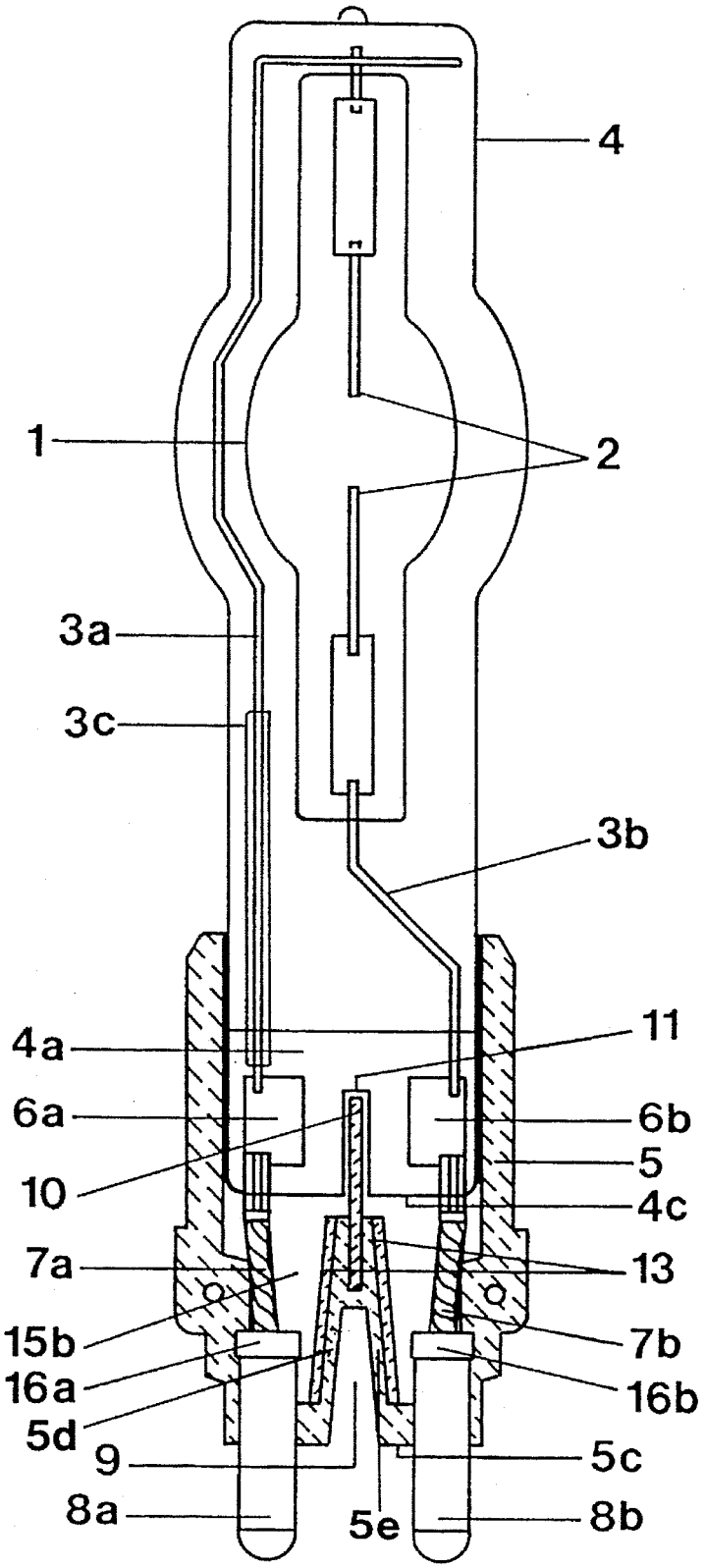
FIG. 1 is a side view of the lamp to which the present invention relates, in which the base is shown partly in section, and illustrating a preferred embodiment.

Referring first to FIG. 1, which shows the general construction of a single-ended high-pressure discharge lamp:

The lamp has a discharge vessel 1, typically made of quartz glass, which retains a fill gas which is ionizable. Two electrodes 2 are melt-sealed in the discharge vessel. The discharge vessel[1]/is retained within an outer envelope 4 by a two-part mount having mount elements 3*a*, 3*b*. The bulb 4 is evacuated. The mount element 3*a* is surrounded, in part, by a quartz-glass tube 3*c* which is melt-sealed into the end 4*a* of the outer bulb 4. The outer bulb 4 is, essentially, axially symmetrical, and the end portion 4*a* is pinch-sealed or press-sealed together, retaining the quartz-glass tube 3*c* and molybdenum foils 6*a*, 6*b* therein. The pinch or press seal is gas-tight. The end 4*a* is cemented into a ceramic base 5, as well known. The base 5 is formed of two identical halves 5*a*, 5*b* (see FIG. 3) which are coupled or connected together, for example by screw connections, not shown. The base region is shown in section in FIG. 1.

Figure 2:
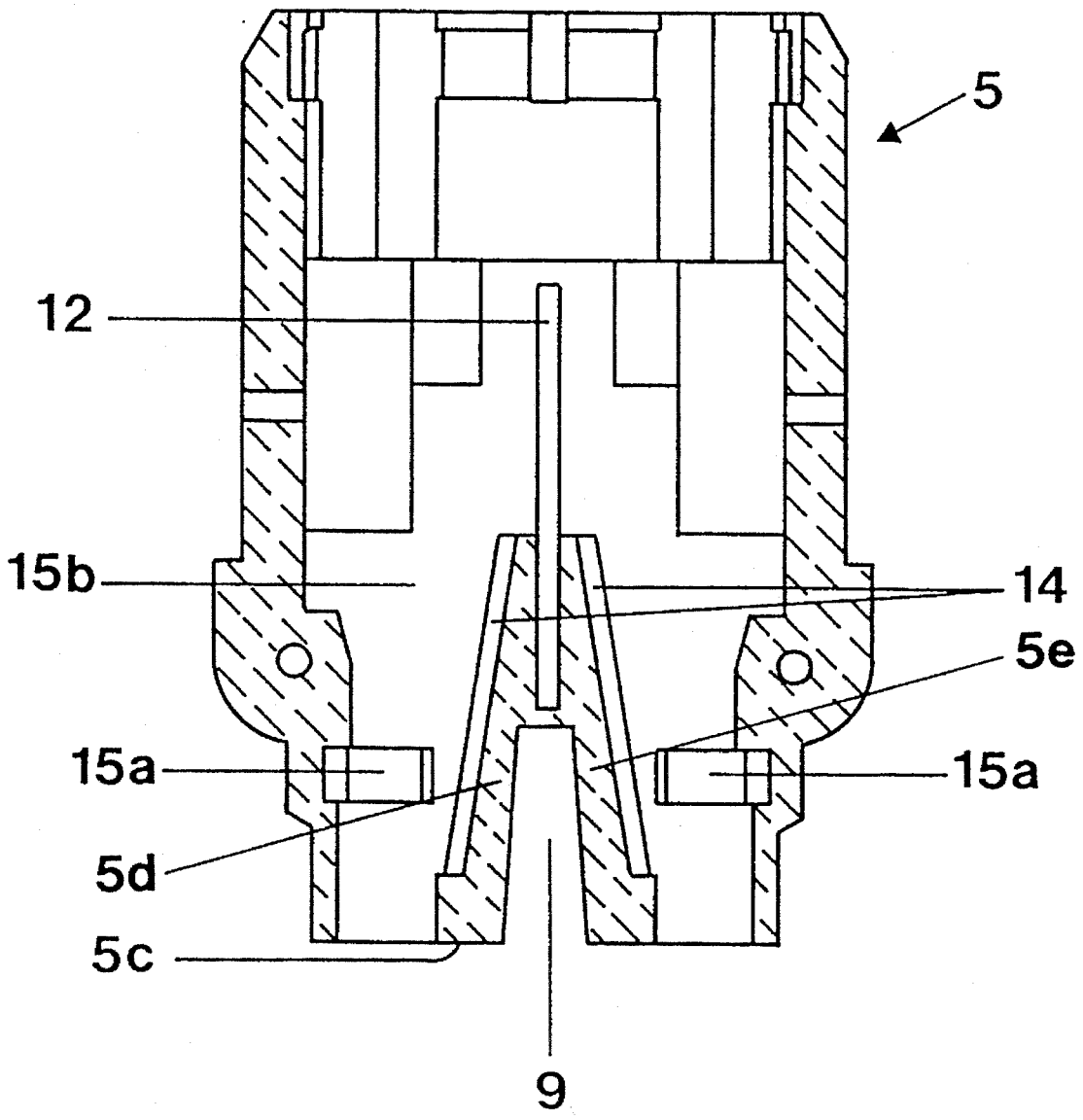
FIG. 2 is a longitudinal sectional view to an enlarged scale of the base, without the lamp and the contact terminal pins or posts.

The two molybdenum foils 6*a*, 6*b* are gas-tightly melt-sealed in a pinch or press seal in the end portion 4*a*, to form an electrically conductive connection to the respective portions of the connections 3*a*, 3*b* to the electrodes 2 of the discharge vessel on the one hand, and to current supply leads 7*a*, 7*b* at the other. The current supply leads 7*a*, 7*b* extend outwardly from the pinch or press seal, and are placed in a cavity 15*b* of the base 5, and, in turn, connected to metallic contact pins or posts 8*a*, 8*b*, projecting from the base 5. The contact pins or posts 8*a*, 8*b* are, internally, slightly enlarged or flanged. The flanges fit into depressions 15*a* (FIGS. 2, 3) formed in the base, so that the pins or posts 8*a*, 8*b* are securely retained in the base and axially positioned. The cavity 15*b* permits differential expansion of the connecting leads, pins or posts, the base, as well as of the end portion 4*a* of the discharge vessel during operation of the lamp, and when the lamp itself gets hot.

In the lower end face 5*c* of the base 5, at the side opposite the lower end 4*a* of the discharge vessel, a depression 9, in form of a groove or a notch, is formed leaving a pair of inwardly extending wall portions 5*d* and 5*e*. It is provided to receive a matching rib projecting from a standard socket into which the lamp can be fitted.

A central separating strip or plate 10 is located within the base 5, centrally between the current supply leads 7*a*, 7*b*, and extending in axial direction. The strip 10 is made of mica. The strip 10 is located in an internal slot 12 formed in the base, and engages into a recess or slit 11 formed in the pinch-sealed end 4*a* of the outer bulb 4. The mica strip extends in the opposite direction towards the end wall or end face 5*c* of the base 5.

Figure 3:
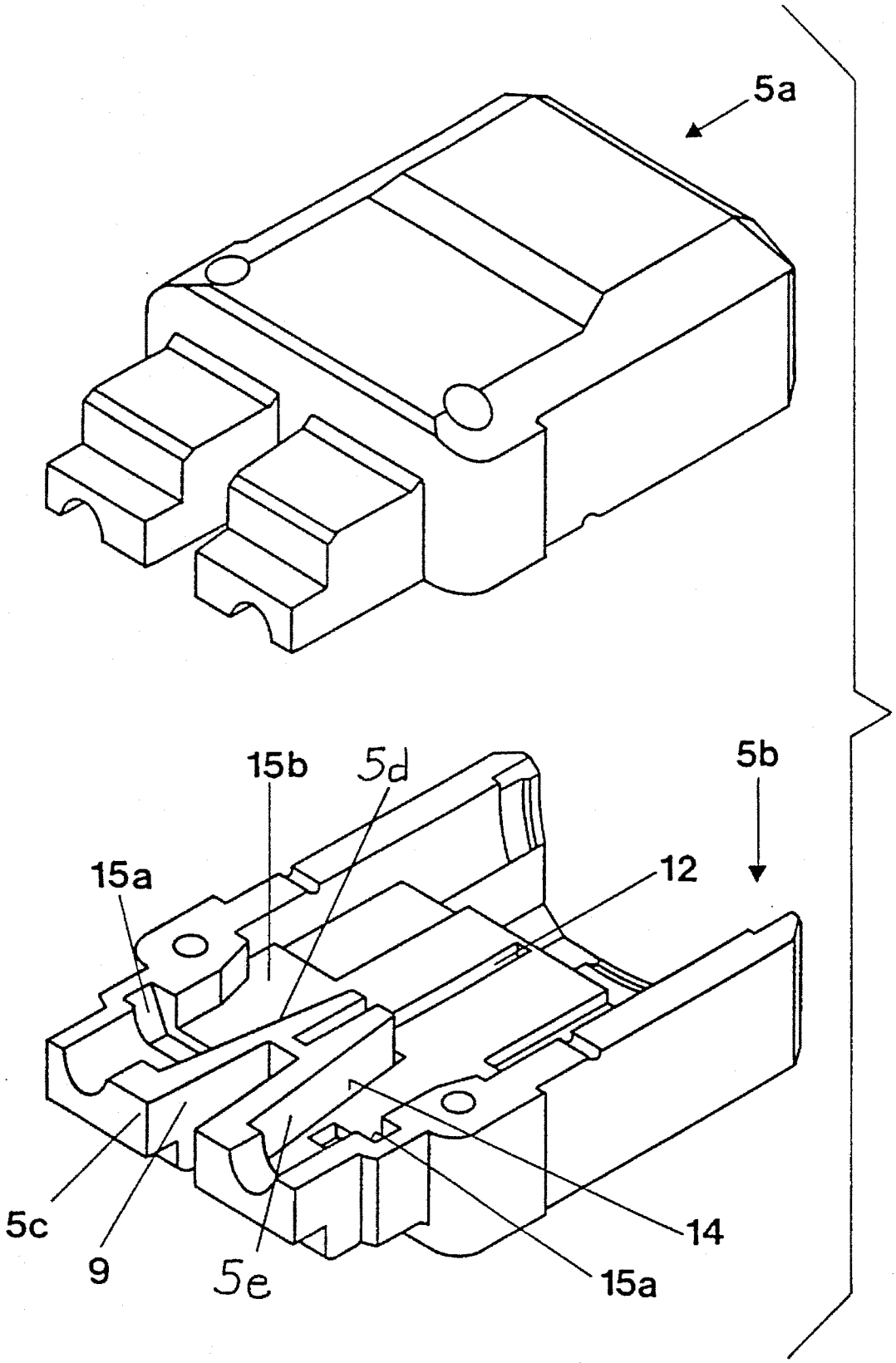
FIG. 3 is an exploded perspective view of two halves of the base body before insertion of the lamp and contact pins or posts.

The central separating strip 10, which is a thin mica plate, is retained in the slots 12 in the base, see FIG. 3.

In accordance with a feature of the invention, further, or additional separating strips 13 are located at both sides of the wall portions 5*d*, 5*e*, next to the recess 9 in the interior of the base 5. They extend in axial direction from the end wall 5*c* up to about the center or middle of the separating strip 10. Almost half of the upper portion—with respect to FIG. 1—of the separating strip 10 is received within the slot 11 of the end portion 4*a* of the vessel 4. The further separating strips 13 extend axially close to the end wall or end face 5*c* of the end portion 4*a* of the outer bulb 4. The further separating strips 13 are made of mica plates and are received in slots 14 formed in the wall of the base 5, see FIG. 3. The further separating strips or plates 13 form an acute angle with the central strip 10, so that only a small distance remains between the separating strips 10 and 13 at the region close to the end portion 4*a* of the bulb 4. The further separating strips 13 extend laterally on both sides of the central slot 9 of the base, and provide additional insulation between the innermost portions of the flanges or rims 16*a*, 16*b* of the contact terminal pins or posts 8*a*, 8*b*. Thus, additional highly insulating material, formed by the further strips 13, is provided at those portions of the lamp where arc-over or corona discharge is most to be feared, that is, at the location where the rims or flanges 16*a*, 16*b*, that is, the current and voltage-carrying parts, are closest together. Since the posts or pins 8*a*, 8*b* have to fit standardized sockets, they cannot be spread apart further as are, for example, the upper ends of the connecting leads 7*a*, 7*b* (see FIG. 1).

Figure 4:
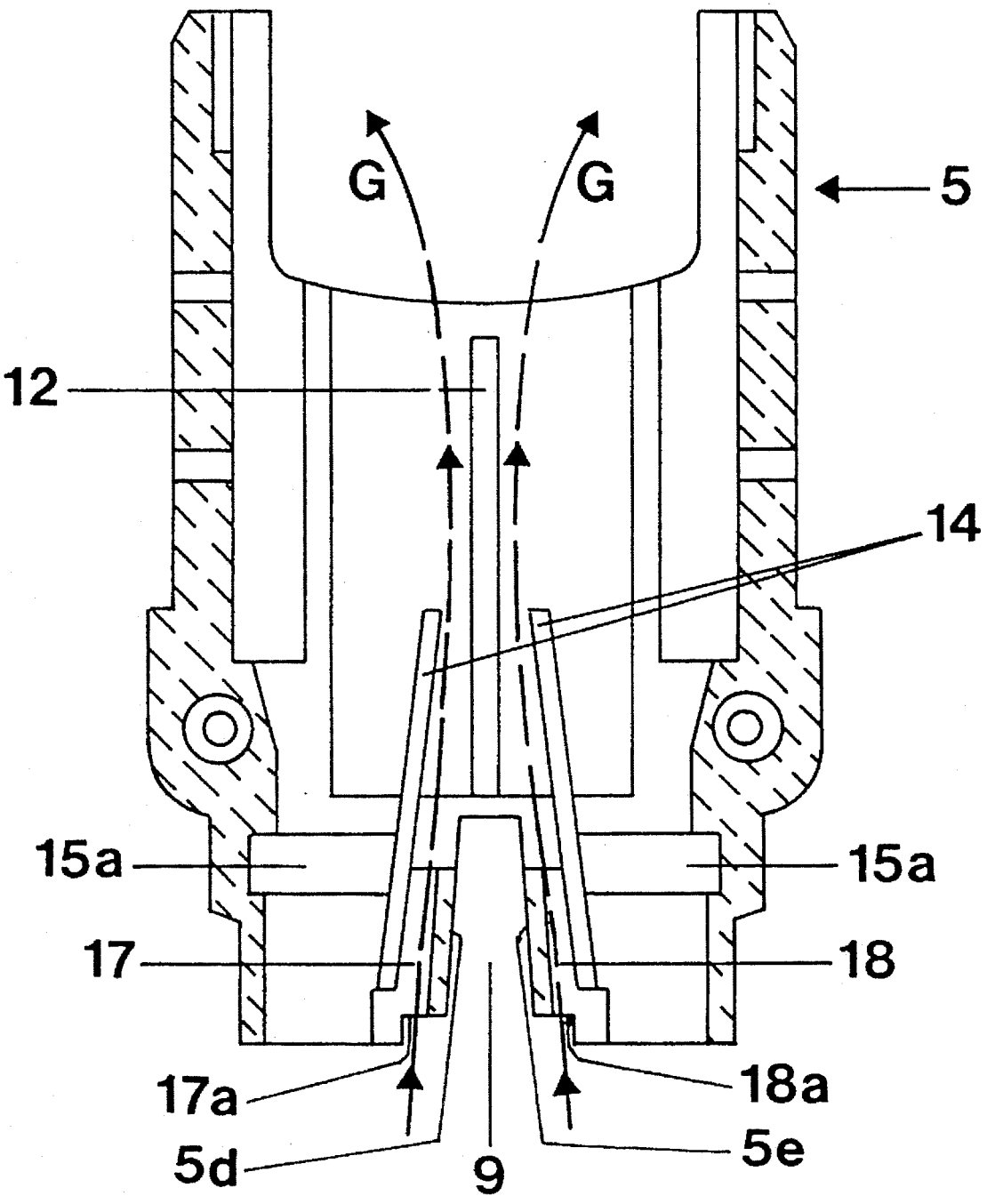
FIG. 4 is a sectional view of a second embodiment of the lamp base, without the lamp and the contact pins or posts.

FIG. 4 shows a cross section through the lamp base 5 in accordance with a second embodiment. This second embodiment differs from the first one only by two approximately axially extending air ducts 17, 18 in the lamp base 5. The air ducts 17, 18 are formed by openings 17*a*, 18*a* in the end wall 5*c* of the base next to the the walls 5*d*, 5*e* of the recess or slot 9 and by the separating strips 10 and 13 retained in the grooves or slots 12 and 14, respectively. They permit cooling air G to flow through the lamp base 5 and thus permit cooling of the pinch-seal end 4*a* of the lamp.

The invention has been described using a 6 kW high-pressure discharge lamp as an example. For such a lamp, the hot-firing or hot-igniting voltage is in the order of about 70 kV. The base is readily capable of accepting such voltages without breakdown. Of course, the invention is not limited to the particular lamp and to the particular example. The invention can be applied also to lamps having bases of higher power, or of somewhat different configuration, for example to lamps of substantially higher power rating, including lamps of 12 kW.

Various changes and modifications may be made within the scope of the inventive concept.

We claim:

1. Single-based, high-power, high-pressure discharge lamp with hot-starting capability, wherein said lamp has a power rating in the kilowatt range and, for hot-starting, requires a starting pulse in a range of over 50 kilovolts, said lamp having an essentially axial-symmetrical lamp bulb (4);

a pinch or press-sealed end portion (4*a*) formed on said bulb;

current connection foils (6*a*, 6*b*) pinch-sealed in the end portion (4*a*);

current supply leads (7*a*, 7*b*) electrically connected to said current connection foils and extending outwardly of the pinch-sealed end portion (4*a*);

a ceramic base (5) in which said bulb (4) and the end portion (4*a*) are secured, said ceramic base defining an end wall (5*c*) remote from the pinch-sealed end portion of the bulb secured in the base;

two terminal pins or posts (8*a*, 8*b*) extending outwardly of the base (5) from said end wall (5*c*) and electrically connected to said current supply leads (7*a*, 7*b*);

circumferentially projecting end flanges or rims (16*a*, 16*b*) at inner terminations of said terminal pins or posts (8*a*, 8*b*), located inwardly of the base;

wherein the base (5) is formed with recesses (15*a*) positioned, dimensioned and shaped to receive said circumferentially projecting flanges or rims, and to locate and positively retain the terminal pins or posts in the base;

a central separating strip or plate (10) of highly electrically insulating material extending between at least part of the current supply leads (7*a*, 7*b*), said lamp further comprising, in accordance with the invention, two auxiliary separating strips or plates (13) of highly electrically insulating material located within the base (5) and extending axially between the projecting end flanges or rims (16*a*, 16*b*) of the two terminal pins or posts (8*a*, 8*b*) and, also, extending axially between at least part of the current supply leads (7*a*, 7*b*), said auxiliary separating strips or plates (13) being located within said base with respect to opposite sides of said central separating strip or plate (10);

wherein the end wall (5*c*) of the base (5) is formed with an inwardly extending depression or slot (9) positioned between inwardly extending end wall portions (5*d*, 5*e*), and located between the terminal pins or posts (8*a*, 8*b*), said end wall (5*c*) further being formed with air duct openings (17*a*, 18*a*) leading to the interior of the ceramic base; and wherein the separating strips (10, 13) and inner surfaces of the end wall portions (5*d*, 5*e*) of the depression or slot (9) form air ducts (17, 18) permitting cooling air (G) to flow through the lamp base (5).

2. The lamp of claim 1, wherein the auxiliary separating strips or plates (13) are located inwardly of the base, adjacent the recess or slot (9) formed in the end wall (5*c*) of the base.

3. The lamp of claim 1, wherein the auxiliary separating strips or plates (13) extend in axial direction close to the terminal surface of said pinch or press-sealed end portion (4*a*) of the bulb at the one end, and close to the inner surface of the end wall (5*c*) of the ceramic base at the other end.

4. The lamp of claim 1, wherein said auxiliary separating strips or plates (13) extend from the inner surface of the end wall (5*c*) of the base to about half the height of the axially extending central separating strip or plate (10).

5. The lamp of claim 1, wherein the two auxiliary separating strips or plates (13) extend at an inclination, forming an acute angle with respect to the central separating strip or plate (10).

6. The lamp of claim 1, wherein said auxiliary separating strips or plates (13) comprise mica.

7. The lamp of claim 1, wherein said central separating strip or plate (10) comprises mica.

8. The lamp of claim 1, wherein said central separating strip or plate (10), and the auxiliary separating strips or plates (13) all are mica strips or plates.

9. The lamp of claim 1, wherein the base (5) is formed with grooves or slots (12, 14) at the inside positioned, dimensioned and shaped to receive and retain said separating strips (10, 13) therein.

10. The lamp of claim 1, wherein said auxiliary separating strips or plates (13) extend in an outward axial direction beyond the flanges or rims for providing additional highly insulating material between the flanges or rims of the terminal pins or posts and adjacent portions of the pins or posts.

11. The lamp of claim 1, wherein the inwardly extending wall portions (5*d*, 5*e*) converge in a direction towards the end portion (5*a*) of the bulb; and wherein said auxiliary separating strips or plates (13) are located adjacent said converging wall portions (5*d*, 5*e*), tapering from a position close to the circumferentially projecting end flanges or rims (16*a*, 16*b*) of the terminal pins or posts (8*a*, 8*b*) towards a central axis of the lamp bulb (4).

12. The lamp of claim 1, wherein said base and said inwardly extending end wall portions (5*d*, 5*e*) are formed with pin reception grooves (15*a*, 15*b*) dimensioned and positioned to receive the projecting end flanges or rims (16*a*, 16*b*) of the terminal pins or posts (8*a*, 8*b*).

13. The lamp of claim 1, wherein said lamp has a power rating of at least about 6 kW, and requires, for hot-starting, a starting pulse in the order of about 70 kV.

14. The lamp of claim 10, wherein said lamp has a power rating of at least about 6 kW, and requires, for hot-starting, a starting pulse in the order of about 70 kV.

* * * * *